US009846382B2

(12) United States Patent
Makiura et al.

(10) Patent No.: US 9,846,382 B2
(45) Date of Patent: Dec. 19, 2017

(54) IMAGE FORMING APPARATUS AND IMAGE FORMING METHOD

(71) Applicant: FUJI XEROX CO., LTD., Tokyo (JP)

(72) Inventors: Shinya Makiura, Ebina (JP); Hirofumi Hamada, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/232,549

(22) Filed: Aug. 9, 2016

(65) Prior Publication Data

US 2017/0205727 A1 Jul. 20, 2017

(30) Foreign Application Priority Data

Jan. 14, 2016 (JP) ..... 2016-005350

(51) Int. Cl.
*G03G 15/02* (2006.01)
*G03G 15/00* (2006.01)

(52) U.S. Cl.
CPC ..... *G03G 15/0266* (2013.01); *G03G 15/5029* (2013.01)

(58) Field of Classification Search
None
See application file for complete search history.

(56) References Cited

U.S. PATENT DOCUMENTS 5,365,316 A * 11/1994 Motoyama ..... G03G 15/0283 363/25

FOREIGN PATENT DOCUMENTS

| | | |
|---|---|---|
| JP | 2009-036792 A | 2/2009 |
| JP | 2009-192743 A | 8/2009 |
| JP | 2010-156921 A | 7/2010 |
| JP | 2011-053346 A | 3/2011 |

* cited by examiner

*Primary Examiner* — Clayton E Laballe
*Assistant Examiner* — Jas Sanghera
(74) *Attorney, Agent, or Firm* — Oliff PLC

(57) ABSTRACT

An image forming apparatus includes an image processing unit and a switching unit. The image processing unit includes: a charging unit that is provided to face an image carrier and applies a direct current voltage on which an alternating voltage of a first frequency is superimposed to charge the image carrier; an electrostatic latent image forming unit that forms an electrostatic latent image on the charged image carrier with light scanning based on image information; a developing unit that develops the electrostatic latent image; and a transfer unit that transfers the developed image to a recording medium. When an image density based on the image information is greater than or equal to a specific image density, the switching unit switches a frequency of the alternating voltage at least during charging performed by the charging unit to a second frequency different from the first frequency.

8 Claims, 6 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2016-005350 filed Jan. 14, 2016.

BACKGROUND

1. Technical Field

The present invention relates to an image forming apparatus and an image forming method.

2. Related Art

An alternating current may be superimposed at the time of charging a photoconductor in an image forming apparatus that, after uniformly charging the surface of the photoconductor as an image carrier, forms an electrostatic latent image based on image information, develops an image with supply of a developer (for example, toner), and transfers the developed image to a transfer receiver.

It is known that discharge noise is generated (audible sound due to resonance is generated) by interference between the natural frequency of the photoconductor and a frequency which is twice the frequency of the alternating current voltage that is superimposed on a direct current voltage at the time of charging.

SUMMARY

According to an aspect of the invention, an image forming apparatus includes an image processing unit and a switching unit. The image processing unit includes a plurality of devices. The plurality of devices include: a charging unit that is provided to face an image carrier and applies a direct current voltage on which an alternating voltage of a first frequency is superimposed to charge the image carrier; an electrostatic latent image forming unit that forms an electrostatic latent image on the charged image carrier with light scanning based on image information; a developing unit that develops the electrostatic latent image; and a transfer unit that transfers the developed image to a recording medium. When an image density based on the image information is greater than or equal to a specific image density, the switching unit switches a frequency of the alternating voltage at least during charging performed by the charging unit to a second frequency different from the first frequency.

BRIEF DESCRIPTION OF THE DRAWINGS

Exemplary embodiments of the present invention will be described in detail based on the following figures, wherein.

DETAILED DESCRIPTION

Figure 1:
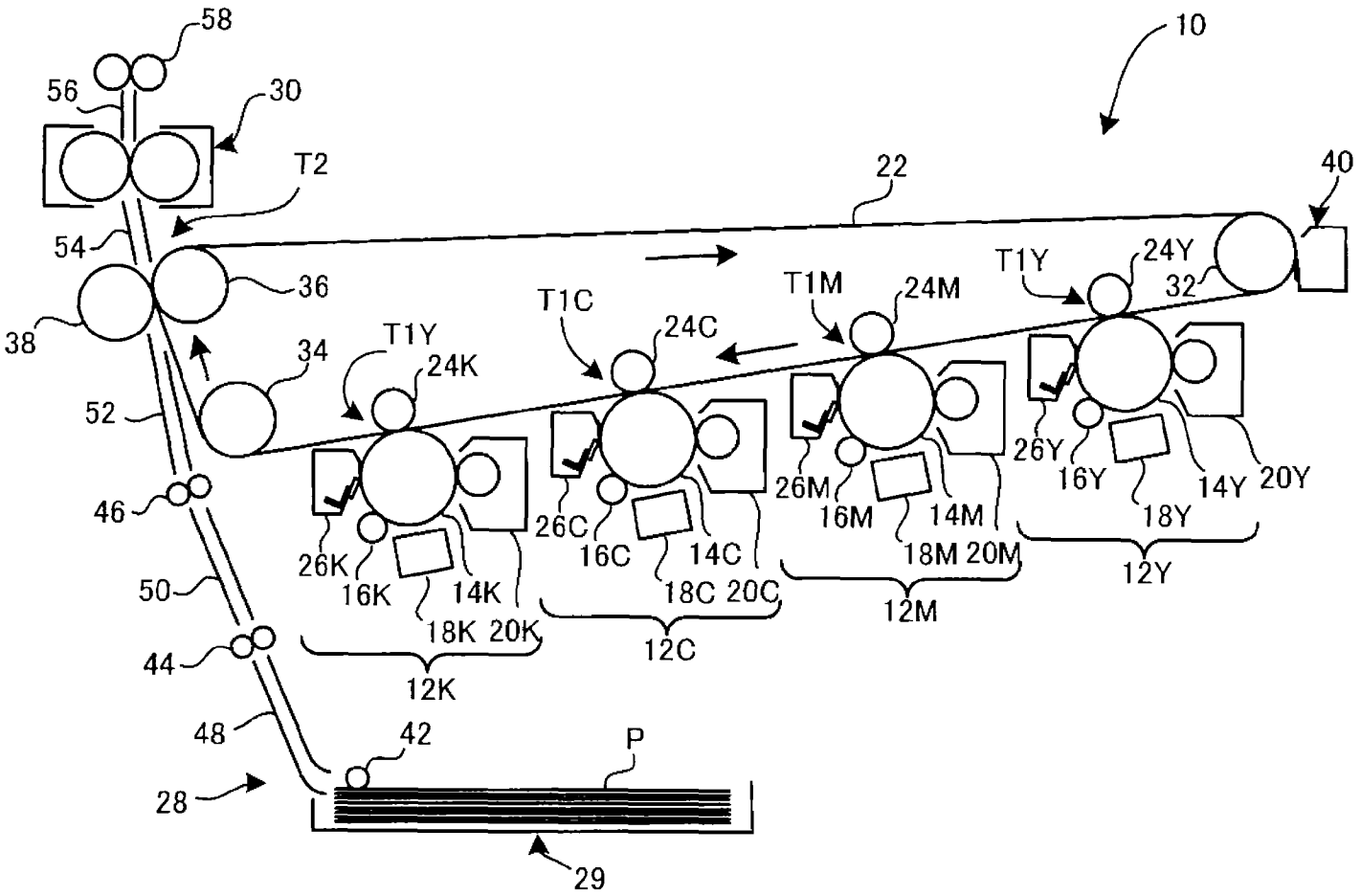
FIG. 1 is a front view of an image forming apparatus according to a present exemplary embodiment.

FIG. 1 is a schematic configuration diagram of an image forming apparatus 10 to which a present exemplary embodiment is applied.

The image forming apparatus 10 is a four-gang tandem type capable of full-color image formation (image formation may be referred to as "printing"), in which a first image forming unit 12Y, a second image forming unit 12M, a third image forming unit 12C, and a fourth image forming unit 12K of an electrophotographic system that respectively output images in colors of yellow (Y), magenta (M), cyan (C), and black (K) are arranged at predetermined intervals in order from an upstream side.

Hereinafter, the four-gang first image forming unit 12Y, the second image forming unit 12M, the third image forming unit 12C, and the fourth image forming unit 12K that have the same configuration will be referred to as "image forming unit 12" if referred to collectively. The suffixes ("Y", "M", "C", and "K") of the reference signs of each constituent of the image forming unit 12 described in FIG. 1 may be omitted in a case where each constituent is not distinguished in description thereof.

The image forming unit 12 includes a photoconductor drum 14 that has a drum shape and includes a photoconductive layer on the surface thereof, a charging unit 16 that uniformly charges the photoconductor drum 14, an exposing unit 18 that irradiates the uniformly charged photoconductor drum 14 with image light to form an electrostatic latent image, a developing unit 20 that transfers toner to the latent image to form a toner image, and a cleaning unit 26 that removes toner remaining on the photoconductor drum 14 after transfer.

The image forming apparatus 10 includes an intermediate transfer belt 22 that has an endless belt shape and is stretched in a circumferentially movable manner along a path which is in contact with each photoconductor drum 14 of the image forming unit 12 of four-gang type, and a primary transfer roll 24 that transfers the toner image formed on the photoconductor drum 14 to the intermediate transfer belt 22. A region in which the photoconductor drum 14 confronts the primary transfer roll 24 will be referred to as a primary transfer unit T1.

The image forming apparatus 10 includes a recording sheet transporting mechanism 28 that transports a recording sheet P accommodated in a sheet tray 29, and a fixing unit 30 that fixes a toner image on the recording sheet P.

The intermediate transfer belt 22 is suspended and rotated by a drive roll 32 that is rotationally driven, a tension roll 34 that adjusts tensile force, and a backup roll 36 as a facing member. The primary transfer roll 24 is provided inside of the intermediate transfer belt 22.

A secondary transfer roll 38 as a transfer member that transfers a toner image on the intermediate transfer belt 22 onto the recording sheet P transported by the recording sheet transporting mechanism 28 is provided in a position that faces the backup roll 36 across the intermediate transfer belt 22 therebetween. A region in which the backup roll 36 confronts the secondary transfer roll 38 will be referred to as a secondary transfer unit T2.

A toner removing unit 40 that removes toner remaining on the intermediate transfer belt 22 after the secondary transfer roll 38 transfers a toner image onto the recording sheet P is included in a position that faces the drive roll 32 across the intermediate transfer belt 22 therebetween.

The recording sheet transporting mechanism 28 is configured with a pickup roll 42, transport rolls 44 and 46, paper guides 48, 50, 52, 54, and 56 that guide a transport movement path of the recording sheet transporting mechanism 28, an ejection roll 58, an ejection tray (not illustrated), and the like. The recording sheet transporting mechanism 28 is driven to transport the recording sheet P accommodated in the sheet tray 29 to a secondary transfer position in which the secondary transfer roll 38 faces the backup roll 36 across the intermediate transfer belt 22 therebetween, is then driven to transport the recording sheet P from the secondary transfer position to the fixing unit 30, and is then driven to transport the recording sheet P from the fixing unit 30 to the ejection tray.

Engine Unit Control System

Figure 2:
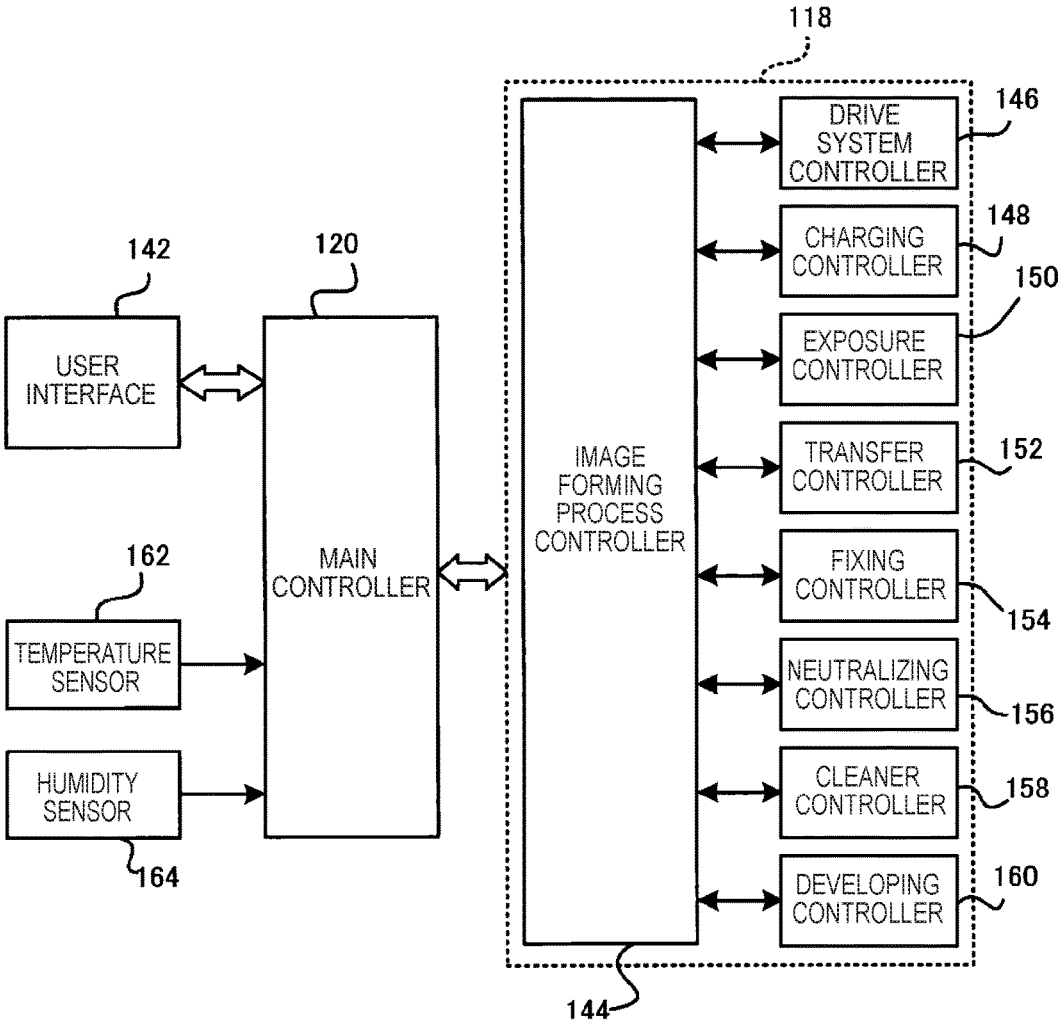
FIG. 2 is a control block diagram of an image forming process engine of the image forming apparatus according to the present exemplary embodiment.

FIG. 2 is a block diagram illustrating one example of a control system of the image forming apparatus 10.

A user interface 142 is connected to a main controller 120 that provides a main control function of the image forming apparatus 10. The user interface 142 includes an input unit for input of instructions related to image formation and the like and an output unit for displayed or sounded notification of information at the time of image formation and the like.

A network line to an external host computer, not illustrated, is connected to the main controller 120, and image data is input into the main controller 120 through the network line.

The main controller 120, when image data is input thereinto, for example, analyzes the image data and print instruction information included in the image data, converts the image data into a format appropriate for the image forming apparatus 10 (for example, bitmap data), and sends the converted image data to an image forming process control unit 144 that functions as a part of an MCU 118.

The image forming process control unit 144 controls, in a synchronized manner based on the input image data, a drive system control section 146, a charging control section 148, an exposure control section 150, a transfer control section 152, a fixing control section 154, a neutralizing control section 156, a cleaner control section 158, and a developing control section 160, each of which functions as the MCU 118 with the image forming process control unit 144, and performs image formation. Functions performed by the MCU 118 are described as being classified into blocks in the present exemplary embodiment. A hardware configuration of the MCU 118 is not limited.

A temperature sensor 162, a humidity sensor 164, and the like are connected to the main controller 120. The ambient temperature and the ambient humidity in a casing of the image forming apparatus 10 may be detected based on the temperature sensor 162 and the humidity sensor 164.

The image forming unit 12 that includes the photoconductor drum 14 and the charging unit 16 is attached to a casing frame and the like through a bracket which is not illustrated. Thus, the photoconductor drum 14, when rotationally driven, has a natural frequency according to the rigidity of the bracket and a state of attachment that includes places of attachment and the number of places of attachment by a screw and the like. In other words, the natural frequency of the photoconductor drum 14 depends on the configuration of supporting the photoconductor drum 14.

A charging voltage is generated in the charging unit 16 by superimposing an alternating current voltage having a specific frequency on a direct current voltage. Superimposition of the alternating current voltage allows the photoconductor drum 14 to be charged stably and at a lower voltage than charging with only the direct current voltage.

The frequency of the alternating current voltage applied to the charging unit 16 (hereinafter, referred to as a charging unit frequency f) interferes with a scanning line when the exposing unit 18 writes an electrostatic latent image in accordance with image information, and may be the cause of generating an image quality defect (particularly, a moire). A moire refers to a thick/thin pitch generated in an image.

Figure 3A:
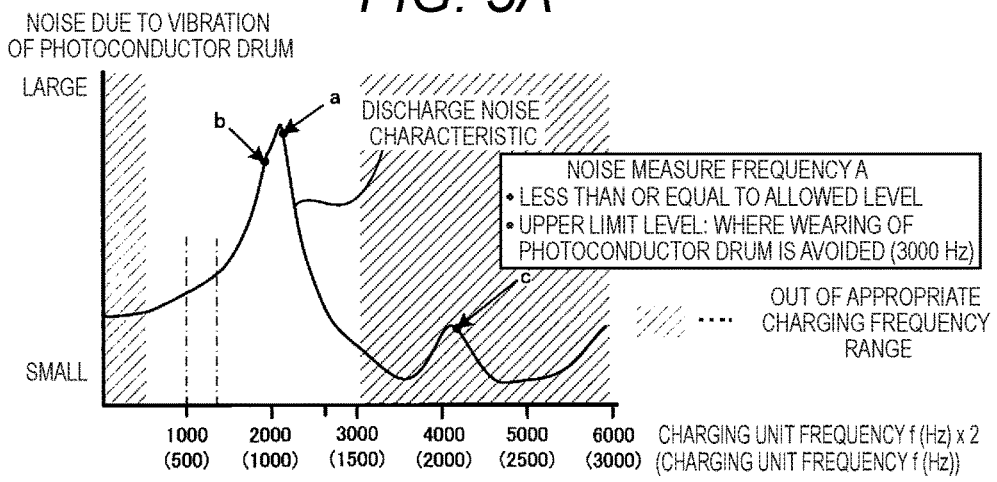
FIG. 3A is a diagram showing characteristics between frequencies of an alternating current of a charging unit and discharge noise.

The characteristic curve of FIG. 3A shows a trend of discharge noise that is generated by interference (audible sound that is caused by resonance) between the applied natural frequency of the photoconductor drum 14 and the charging frequency f of the charging unit 16.

For discharge noise, it is known that the maximum discharge noise is generated by interference between a frequency which is twice the frequency of the charging unit frequency f and the natural frequency of the photoconductor drum 14.

The principle of discharge noise generation caused by the charging frequency f is described as follows.

The discharge noise is caused by forced vibration that is generated by electrostatic attraction force due to the frequency of an alternating current voltage applied to the charging unit 16 (charging frequency f).

The electrostatic attraction force is proportional to the square of a voltage applied to the charging unit 16, and noise peaks occur at a frequency which is twice the frequency f of the alternating current voltage set for the charging unit 16.

The maximum value (peak) of the discharge noise occurs near the charging frequency fin a range of 900 Hz to 1,000 Hz (1,800 Hz to 2,000 Hz when doubled) in the characteristic curve of FIG. 3A. This frequency band is in the range (2,000 Hz to 4,000 Hz) that is most audible by human ears in the audible frequency bandwidth (20 Hz to 20,000 Hz). Types of sound in the range most audible by human ears are exemplified by a crying sound of a baby, a scream of a woman, and an alert alarm of an electronic appliance.

Multiple types of vibrations exist in the photoconductor drum 14 (refer to arrows a, b, and c of FIG. 3A).

(Vibration type a) vibration in which the photoconductor drum 14 microscopically has a crown shape and a reel shape repeated (Vibration type b) vibration of the axis line of the photoconductor drum 14 in a bow shape (displacement)

(Vibration type c) vibration in which the photoconductor drum 14 is deformed in the direction of the axis line thereof (expansion and contraction)

It is experimentally proven that the vibration type a occurs in the photoconductor drum 14 at the maximum value of the discharge noise (refer to the arrow a of FIG. 3A). That is, as measures against the discharge noise, the charging frequency f is required to be avoided being, particularly, near 900 Hz to 1,100 Hz in addition to being in the above most audible range (2,000 Hz to 4,000 Hz). Specifically, the charging frequency f is preferably set to approximately 500 Hz to 600 Hz.

Figure 3B:
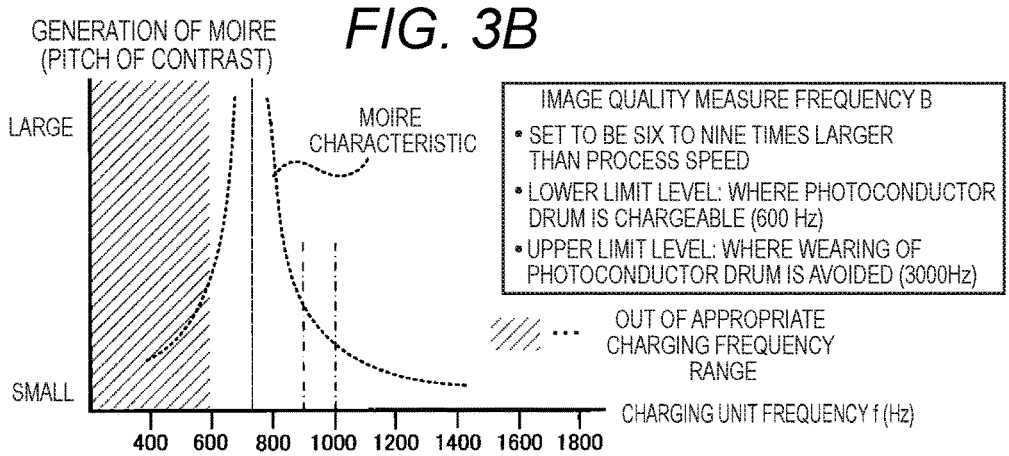
FIG. 3B is a diagram showing characteristics between the frequencies of the alternating current of the charging unit and generation of moire.

FIG. 3B is a characteristic curve showing a thick/thin state of a moire generated at the time of image formation according to the charging frequency f of the charging unit 16. The image quality is degraded as a difference between a thick part and a thin part in the moire is increased.

As illustrated in the characteristic curve of FIG. 3B, the maximum value (peak) at which the image quality defect, that is, the thick/thin pitch of the generated moire, is noticeable occurs near the charging frequency f equal to 750 Hz (±100 Hz). For the reference, the pinpoint charging unit frequency f at the maximum value (infinity) of the characteristic curve does not generate a moire but is not appropriate for practical use.

Thus, the charging frequency f set for measures for the image quality, that resides in an appropriate application range below an allowed level of generation of the image quality defect (moire) is required to be avoided being near 750 Hz (±100 Hz) in the photoconductor drum 14 (image quality reduction condition 1).

The charging unit frequency f is required to be set in the range of a lower limit value of a frequency (greater than or equal to 600 Hz) which is greater than a frequency at which the photoconductor drum 14 can not be charged (for example, a minimum frequency at which the photoconductor drum 14 is chargeable) to an upper limit value (less than or equal to 3,000 Hz) which is lower than a frequency at which wearing of the photoconductor drum 14 is aggravated (for example, a maximum frequency at which impact on the photoconductor drum 14 is allowed), depending on the process speed of the image forming apparatus 10 to which the charging unit frequency f is applied (image quality reduction condition 2).

The charging unit frequency f that allows compatibility of the image quality reduction condition 1 and the image quality reduction condition 2 in the practical use thereof has an appropriate application range of 900 Hz to 1,000 Hz in the present exemplary embodiment.

The image formed on the recording sheet P is relatively sparse in a case where the image density of the image is less than 15%, and the moire may not affect the image. The image is relatively dense when having an image density greater than or equal to 15%, and the moire noticeably affects the image quality.

Figure 3C:
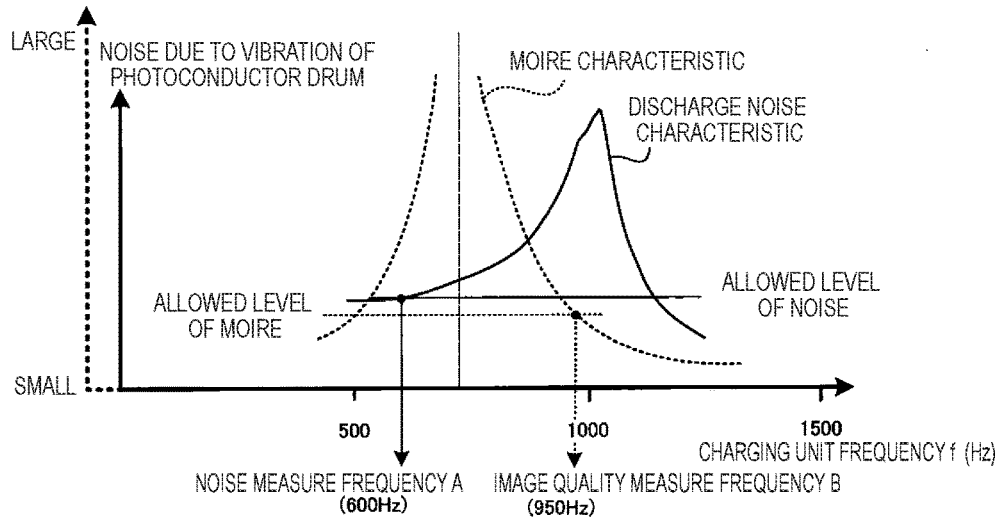
FIG. 3C is a discharge noise characteristic diagram and a moire generation characteristic diagram with the horizontal axes of FIGS. 3A and 3B being used as common frequencies of the alternating current of the charging unit.

FIG. 3C is a characteristic diagram in which both of the characteristic curves shown in FIGS. 3A and 3B are superimposed in a common range so that the horizontal axis of the charging frequency and noise characteristic curve shown in FIG. 3A and the horizontal axis of the charging frequency and image quality (moire) characteristic curve shown in FIG. 3B are placed on a common horizontal axis.

As illustrated in FIG. 3C, it is difficult to select the charging frequency f at which the charging unit frequency f of the noise measures is compatible with the charging unit frequency f of the image quality measures. In other words, charging unit frequency f of the noise measures and the charging unit frequency f of the image quality measures are difficult to coexist in a predetermined frequency range.

From the viewpoint of practical use, for example, the charging unit frequency f of the noise measures is preferably 500 Hz to 600 Hz, while the charging unit frequency f of the image quality measures is preferably 900 Hz to 1,000 Hz as described above.

The present exemplary embodiment stores in advance the charging unit frequency f between 500 Hz and 600 Hz as noise measure frequency A (for example, noise measure frequency A←600 Hz) and the charging unit frequency f between 900 Hz and 1,000 Hz as an image quality measure frequency B (for example, image quality measure frequency B←950 Hz) and appropriately switches and uses the noise measure frequency A and the image quality measure frequency B based on the operating status of an image forming process and the image density. The noise measure frequency A is a first frequency, and the image quality measure frequency B is a second frequency.

Figure 4:
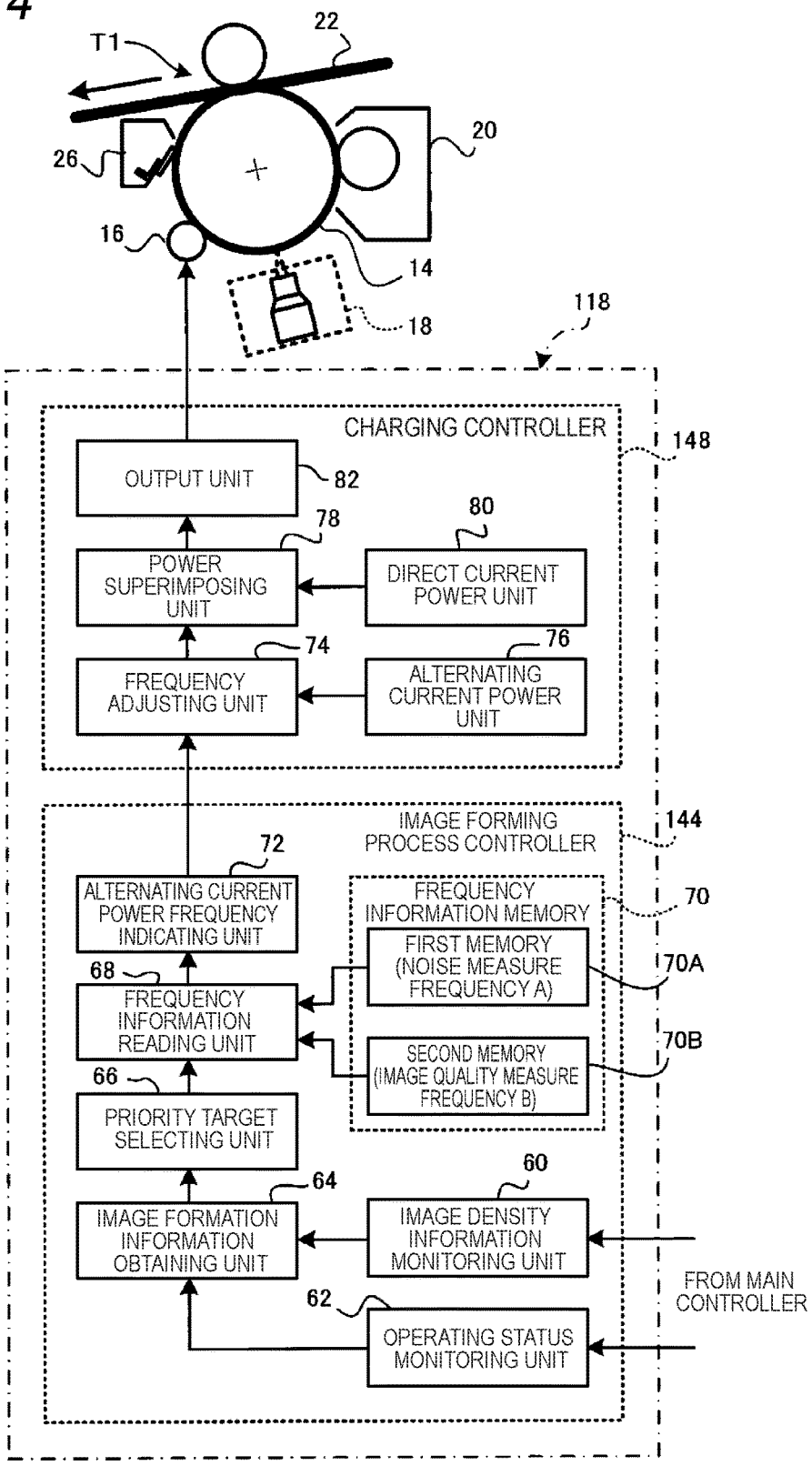
FIG. 4 is a functional block diagram for a charging unit frequency adjusting control performed by an image forming process control unit and a charging control section according to the present exemplary embodiment.

FIG. 4 functionally illustrates processing by the image forming process control unit 144 and the charging control unit 148 in which a control for switching the charging unit frequency is performed. The functional block diagram of FIG. 4 does not limit the hardware configurations of the image forming process control unit 144 and the charging control section 148.

An image density information monitoring unit 60 and an operating status monitoring unit 62 are provided in the image forming process control unit 144.

The image density information monitoring unit 60 acquires image data from the main controller 120 (refer to FIG. 2). The image density information monitoring unit 60, when image data is acquired, for example, classifies 15% of a toner amount as a boundary for the image density of each page, classifies an image as a low-density image in a case where the toner amount is less than 15%, and classifies an image as a high-density image in a case where the toner amount is greater than or equal to 15% (density classification information).

The operating status monitoring unit 62 acquires charging period information for the charging unit 16 from the main controller 120 (refer to FIG. 2). The operating status monitoring unit 62, when charging period information is acquired, classifies the charging period information into a charging preparation period, an exposure period, and a post-charging process period (charging time period classification information).

The image density information monitoring unit 60 and the operating status monitoring unit 62 are connected to an image formation information acquiring unit 64 that acquires the density classification information from the image density information monitoring unit 60 and acquires the charging time period classification information from the operating status monitoring unit 62.

The operating status monitoring unit 62, for example, may acquire transport time period information for the recording sheet P from the main controller 120 (refer to FIG. 2) or acquire the operating status of other devices as well and may send the transport time period information or the operating status of other devices as image formation information to the image formation information acquiring unit 64 if necessary.

The image formation information (includes at least the density classification information and the charging time period classification information) acquired by the image formation information acquiring unit 64 is sent to a priority target selecting unit 66.

The priority target selecting unit 66, based on the image formation information, selects the frequency of an alternating current power (voltage) that is superimposed on a direct current power (voltage) when charging is performed by the charging unit 16. The selection result of the priority target selecting unit 66 is sent to a frequency information reading unit 68. The frequency information reading unit 68 reads from a frequency information memory 70 frequency information that is based on the selection result.

As illustrated in FIG. 3C, frequencies of the alternating current power (voltage) of the charging unit 16 include the noise measure frequency A and the image quality measure frequency B. The noise measure frequency A is a frequency set for discharge noise preventing measures to prevent audible sound caused by resonance with the natural frequency of the photoconductor drum 14 depending on a configuration of supporting the photoconductor drum 14, and the image quality measure frequency B is a frequency set for moire generation preventing measures to prevent generation of irregularity in scanning cycles at a time of forming the electrostatic latent image. The noise measure frequency A is stored in a first memory 70A of the frequency information memory 70, and the image quality measure frequency B is stored in a second memory 70B of the frequency information memory 70.

The priority target selecting unit 66 selects the noise measure frequency A or the image quality measure frequency B in the following selection forms.

(Selection form 1) Select the noise measure frequency A at all times in a case of a low-density image.

(Selection form 2) Select the noise measure frequency A during the charging preparation period and the post-charging process period in a case of a high-density image.

(Selection form 3) Select the image quality measure frequency B during the exposure process period in a case of a high-density image.

The frequency information (the noise measure frequency A or the image quality measure frequency B) read by the frequency information reading unit 68 is sent by an alternating current power frequency instructing unit 72 to a frequency adjusting unit 74 of the charging control section 148.

The priority target selecting unit 66, the frequency information reading unit 68, the alternating current power frequency instructing unit 72, and the frequency adjusting unit 74 function as a switching unit. Switching by the switching unit is made, for example, when the noise measure frequency A and the image quality measure frequency B are unable to coexist in a predetermined frequency range.

An alternating current power unit 76 is connected to the frequency adjusting unit 74 that adjusts the frequency of the alternating current power and sends the alternating current power after adjustment to a power superimposing unit 78.

A direct current power unit 80 is connected to the power superimposing unit 78. The power superimposing unit 78 superimposes the alternating current power on the direct current power to generate a charging power.

The charging power generated by the power superimposing unit 78 charges the charging unit 16 through an output unit 82.

Hereinafter, the effect of the present exemplary embodiment will be described.

Flow of Typical Image Forming Process Mode

The first image forming unit 12Y that is provided on the upstream side in a travel direction of the intermediate transfer belt 22 and forms a yellow image will be representatively described since the image forming unit 12 has approximately the same configuration. Descriptions of the second to fourth image forming units 12M, 12C, and 12K will be omitted by designating members thereof having the same function as the first image forming unit 12Y with the same reference sign to which magenta (M), cyan (C), and black (K) are added instead of yellow (Y).

First, the photoconductor drum 14Y starts rotating prior to operation. Then, the charging unit 16Y applies to the surface of the photoconductor drum 14Y a voltage in which a direct current and an alternating current are superimposed, and charges the surface to a predetermined potential in the present exemplary embodiment. Generally, the voltage can be selected from the range of −400 V to −800 V. For example, the charging unit 16Y applies a voltage in which an alternating current voltage having a specific amplitude Vpp and a specific frequency f is superimposed on a direct current voltage, in a case of charging the photoconductor drum 14Y.

The photoconductor drum 14Y is formed by stacking a photoconductive layer on a conductive metal base body and typically has high resistance. The photoconductor drum 14Y has properties that, when the photoconductor drum 14Y is irradiated with LED light, change the resistance of a part irradiated with the LED light ray.

The exposing unit 18 in the MCU 118 outputs a light beam (for example, LED light) for exposure to the charged surface of the photoconductor drum 14Y in accordance with yellow image data that is sent from the main controller 120. The photoconductive layer of the surface of the photoconductor drum 14Y is irradiated with the light beam, and thereby an electrostatic latent image having a yellow print pattern is formed on the surface of the photoconductor drum 14Y.

The electrostatic latent image is an image that is formed on the surface of the photoconductor drum 14Y by charging and is a so-called negative latent image that is formed in such a manner that electric charges on the charged surface of the photoconductor drum 14Y flow due to a decrease in the resistivity of the part of the photoconductive layer irradiated with the light beam while electric charges remain in the part not irradiated with the light beam.

The electrostatic latent image formed on the photoconductor drum 14Y is rotated to a developing position by the rotation of the photoconductor drum 14Y. The electrostatic latent image on the photoconductor drum 14Y is turned into a visible image (toner image) by the developing unit 20Y in the developing position.

The developing unit 20Y accommodates yellow toner that is manufactured by emulsion polymerization. The yellow toner is friction charged by being agitated in the developing unit 20Y and has electric charges of the same polarity (−) as the electric charges on the surface of the photoconductor drum 14Y.

Passing the surface of the photoconductor drum 14Y through the developing unit 20Y electrostatically attaches the yellow toner to only the neutralized portion of the latent image on the surface of the photoconductor drum 14Y, and the latent image is developed with the yellow toner.

The photoconductor drum 14Y continues rotating, and the toner image that is developed on the surface of the photoconductor drum 14Y is transported to a primary transfer position. When the yellow toner image on the surface of the photoconductor drum 14Y is transported to the primary transfer position, a primary transfer bias is applied to the primary transfer roll 24Y. Then, electrostatic force from the photoconductor drum 14Y toward the primary transfer roll 24Y acts on the toner image, and the toner image on the surface of the photoconductor drum 14Y is transferred to the surface of the intermediate transfer belt 22.

The transfer bias applied at this point has a polarity (+) that is the opposite polarity to the polarity (−) of the toner, and is controlled to be a constant current of, for example, approximately +20 μA to +30 μA in the first image forming unit 12Y by the transfer control section 152.

Toner that remains on the surface of the photoconductor drum 14Y after transfer is cleaned by the cleaning unit 26Y.

The primary transfer bias that is applied to the primary transfer rolls 24M, 24C, and 24K of the second image forming unit 12M and the subsequent image forming units is controlled in the same manner as described above.

The intermediate transfer belt 22 to which the yellow toner image is transferred in the first image forming unit 12Y is transported through the second to fourth image forming units 12M, 12C, and 12K in order, and toner images of each color are multiply transferred to the intermediate transfer belt 22 in an exactly overlaying manner.

The intermediate transfer belt 22 to which the toner images of all colors are multiply transferred through the entire image forming unit 12 is circumferentially transported in the direction of an arrow and reaches the secondary transfer unit T2 that is configured with the backup roll 36 and the secondary transfer roll 38, the backup roll 36 being in contact with the inner surface of the intermediate transfer belt 22 and the secondary transfer roll 38 being provided on the image carrying surface side of the intermediate transfer belt 22.

The recording sheet P is fed to the place between the secondary transfer roll 38 and the intermediate transfer belt 22 at a predetermined timing through a supply mechanism, and a secondary transfer bias is applied to the secondary transfer roll 38.

The transfer bias applied at this point has the opposite polarity (+) to the polarity of the toner (−). Electrostatic force from the intermediate transfer belt 22 toward the recording sheet P acts on the toner image, and the toner image on the surface of the intermediate transfer belt 22 is transferred to the surface of the recording sheet P.

Then, the recording sheet P is transported to the fixing unit 30, and the toner image is heated and pressed. The toner image of overlaid colors is melted and is permanently fixed to the surface of the recording sheet P. The recording sheet P to which the color image is completely fixed is transported toward an ejecting unit, and a series of color image forming operations is ended.

Figure 5:
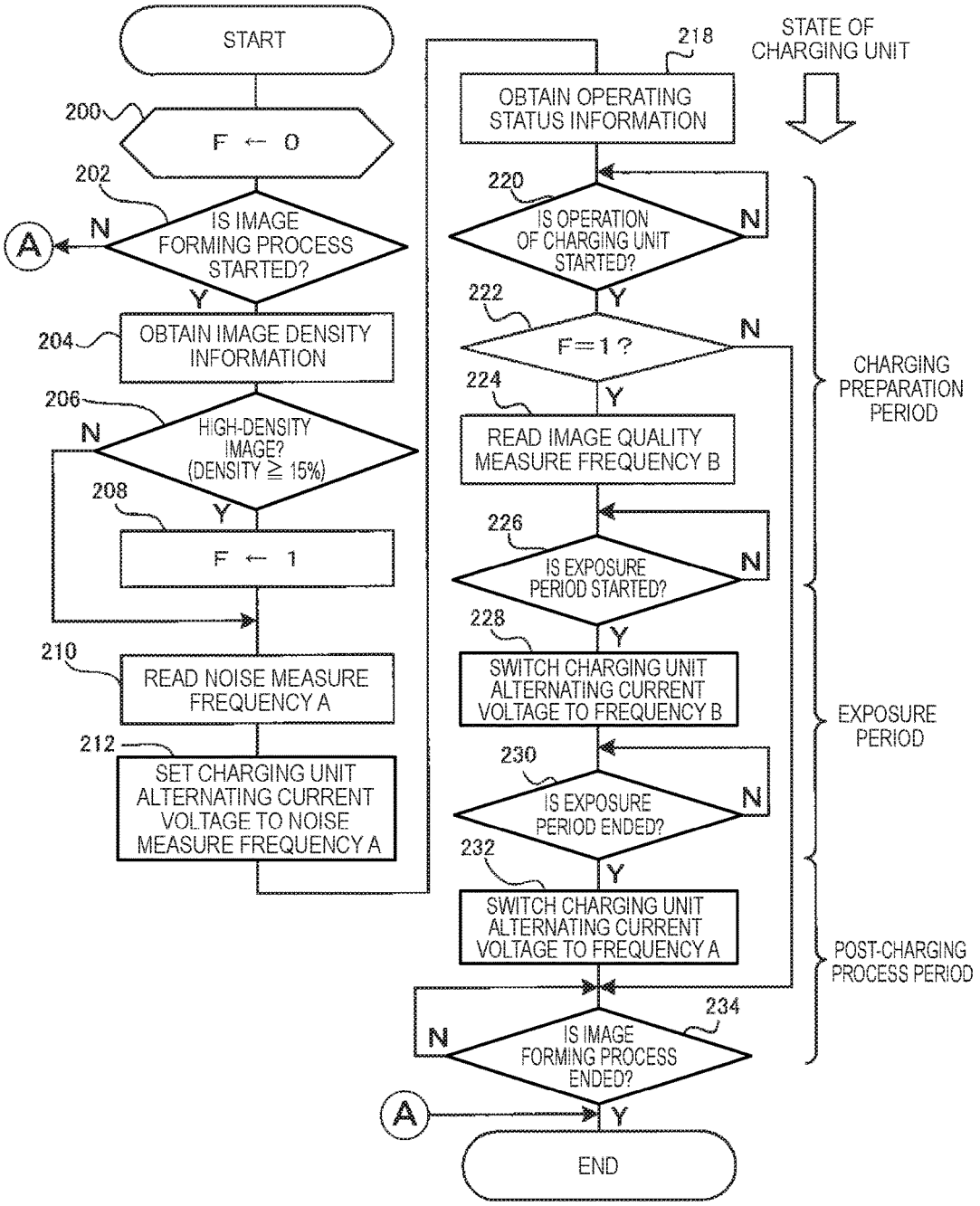
FIG. 5 is a flowchart illustrating a routine of the charging unit frequency adjusting control performed by the image forming process control unit and the charging control section according to the present exemplary embodiment.

FIG. 5 is a flowchart illustrating the flow of an alternating current power frequency selection control that is performed by the image forming process control unit 144 and the charging control section 148 when the charging unit 16 superimposes the alternating current power (voltage) on the direct current power (voltage).

A flag F that is related to the density classification information is reset (F←0) in Step 200. Then, a transition is made to Step 202, and a determination is made as to whether or not an image forming process is started. This routine is ended in a case where a negative determination is made in Step 202.

A transition is made to Step 204 when a positive determination is made in Step 202, and image density information is acquired. Then, a transition is made to Step 206.

A determination is made as to whether or not the acquired image density corresponds to a high-density image (greater than or equal to 15%), in Step 206. When a positive determination is made, that is, the image density is determined to correspond to a high-density image (greater than or equal to 15%), in Step 206, a transition is made to Step 208, and the flag F is set (F←1). Then, a transition is made to Step 210.

A transition is made to Step 210 when a negative determination is made, that is, the image density is determined to correspond to a low-density image (less than 15%), in Step 206.

The noise measure frequency A is read in Step 210, and a transition is then made to Step 212. The alternating current voltage of the charging unit is set to the noise measure frequency A, and a transition is made to Step 218. As a result, the natural frequency of the photoconductor drum 14 does not interfere with the frequency of the alternating current of the charging unit 16 in the charging preparation (noise measure frequency A) even if rotation of the photoconductor drum 14 and operation of the charging unit 16 are started, and noise is not generated.

Figure 6:
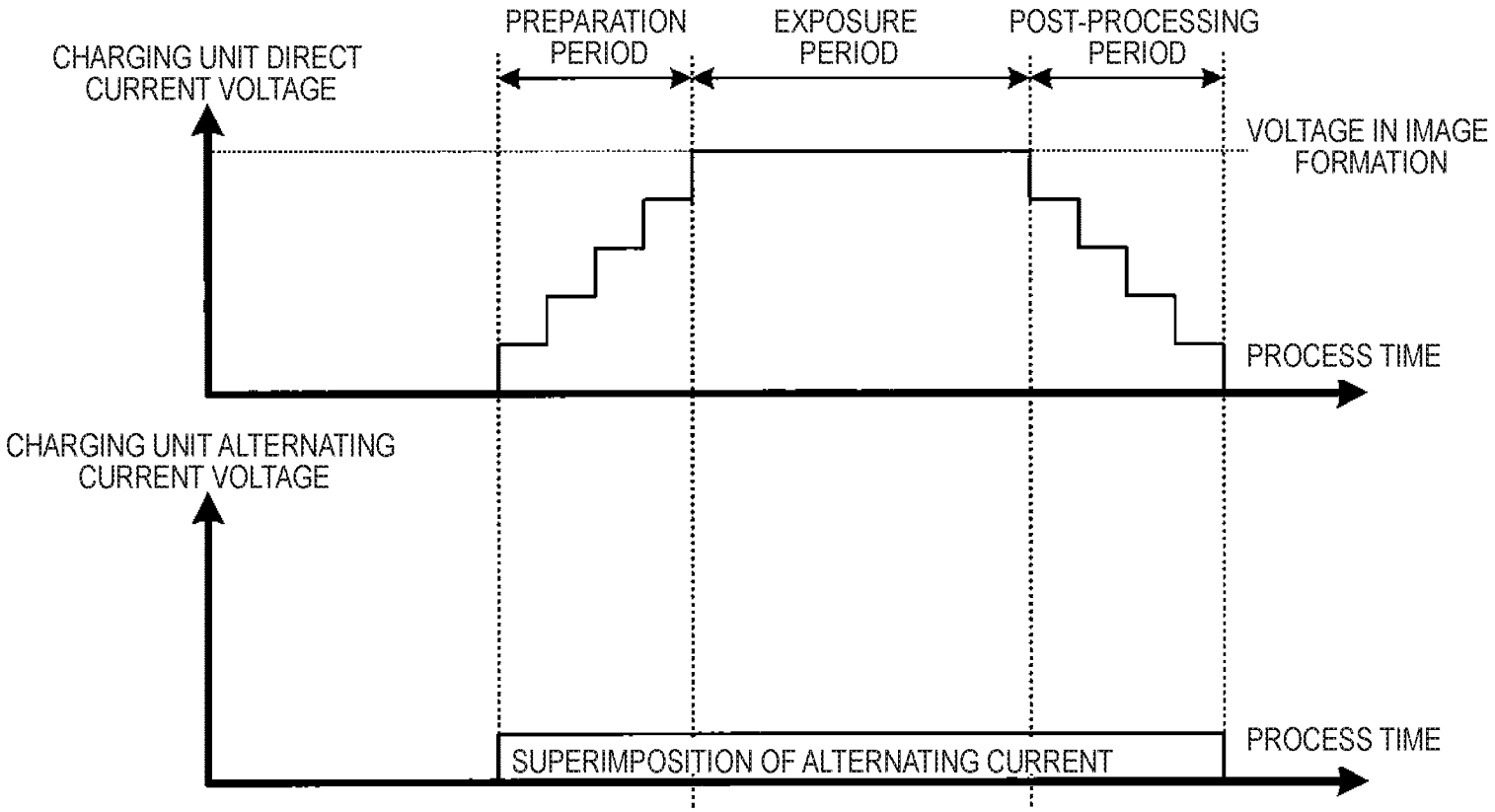
FIG. 6 is a timing chart illustrating application time periods of a direct current voltage and an alternating current voltage in the charging unit.

Operating status information is acquired in Step 218, and a transition is made to Step 220. A determination is made as to whether or not operation of the charging unit 16 is started, based on the operating status information in Step 220. When a positive determination is made, the charging preparation period (refer to FIG. 6) is determined to be present. Then, a transition is made to Step 222, and a determination is made as to whether or not the flag F is set (F←1).

The image forming process is determined to be performed for a high-density image when a positive determination is made, that is, the flag F is determined to be set (F←1), in Step 222, and a transition is made to Step 224. The image quality measure frequency B is read, and a transition is made to Step 226.

A determination is made as to whether or not the exposure period (refer to FIG. 6) is started, in Step 226. when a positive determination is made, a transition is made to Step 228. The alternating current voltage of the charging unit is switched to the image quality measure frequency B, and a transition is made to Step 230. Accordingly, the alternating current voltage of the image quality measure frequency B is superimposed on the direct current voltage during the image formation, and moire generation is suppressed.

A determination is made as to whether or not the exposure period (refer to FIG. 6) is ended, in Step 230. When a positive determination is made, it is determined that a transition is made to the post-charging process period (refer to FIG. 6), and a transition is made to Step 232. The alternating current voltage of the charging unit is switched to the noise measure frequency A, and a transition is made to Step 234. Accordingly, after the exposure process is ended, the natural frequency of the photoconductor drum 14 does not interfere with the frequency of the alternating current of the charging unit 16 in the post-processing (noise measure frequency A) even if the photoconductor drum 14 rotates, and noise is not generated.

The image forming process is determined to be performed for a low-density image (density is less than 15%) when the flag F is determined to be reset (F←0) in Step 222, and charging is performed at the noise measure frequency A that is set. In this case, the image quality is not affected since the image has low density, and the noise measures are prioritized.

A determination is made as to whether or not the image forming process is ended, in Step 234. When a positive determination is made, this routine is ended.

Noise that is caused by the natural frequency of the photoconductor drum 14 may be canceled out in a case where the recording sheet P is in transport and in a case where other devices are operated in the selection form 2.

In response to those cases, classification may be made into the following selection form 2-1 and the selection form 2-2 instead of the selection form 2.

(Selection form 2-1) Select the noise measure frequency A, in a case of a high-density image, during the charging preparation period and the post-charging process period and while the recording sheet P is not in transport and other devices are not operated.

(Selection form 2-2) Select the image quality measure frequency B, in a case of a high-density image, during the charging preparation period and the post-charging process period and while the recording sheet P is in transport or other devices are operated.

As the selection form, for example, in a case of a high-density image, the image quality measure frequency B may be selected at least during charging performed by the charging unit 16.

Further, a period of switching to the image quality measure frequency B by the switching unit may be set to a period from start of transport of the recording sheet P before an image forming process to end of operation of at least one of the plurality of devices (the charging unit 16, the exposing unit 18, the developing unit 20, the primary transfer roll 24, etc.) after the image forming process.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image processing unit that comprises a plurality of devices, the plurality of devices comprising:

a charging unit that is provided to face an image carrier and applies a direct current voltage on which an alternating voltage of a first frequency is superimposed to charge the image carrier;

an electrostatic latent image forming unit that forms an electrostatic latent image on the charged image carrier with light scanning based on image information;

a developing unit that develops the electrostatic latent image; and a transfer unit that transfers the developed image to a recording medium; and a switching unit that, when an image density based on the image information is greater than or equal to a specific image density, switches a frequency of the alternating voltage at least during charging performed by the charging unit to a second frequency different from the first frequency, wherein the first frequency is a frequency set for discharge noise preventing measures to prevent audible sound caused by resonance with a natural frequency of the image carrier depending on a configuration of supporting the image carrier, and wherein the second frequency is a frequency set for moire generation preventing measures to prevent generation of irregularity in scanning cycles at a time of forming the electrostatic latent image.

2. The image forming apparatus according to claim 1, wherein switching by the switching unit is made when the first frequency and the second frequency of the frequency of the alternating voltage are unable to coexist in a predetermined frequency range.

3. The image forming apparatus according to claim 2, wherein a lower limit value of the predetermined frequency range is a minimum frequency at which the image carrier is chargeable, and wherein an upper limit value of the predetermined frequency range is a maximum frequency at which impact on the image carrier is allowed.

4. An image forming apparatus comprising:

an image processing unit that comprises a plurality of devices, the plurality of devices comprising:

a charging unit that is provided to face an image carrier and applies a direct current voltage on which an alternating voltage of a first frequency is superimposed to charge the image carrier;

an electrostatic latent image forming unit that forms an electrostatic latent image on the charged image carrier with light scanning based on image information;

a developing unit that develops the electrostatic latent image; and a transfer unit that transfers the developed image to a recording medium; and a switching unit that, when an image density based on the image information is greater than or equal to a specific image density, switches a frequency of the alternating voltage at least during charging performed by the charging unit to a second frequency different from the first frequency, the switching unit switching to the second frequency in a period that extends from a start of transport of the recording medium before an image forming process to an end of operation of at least one of the plurality of devices after the image forming process, wherein the first frequency is a frequency set for discharge noise preventing measures to prevent audible sound caused by resonance with a natural frequency of the image carrier depending on a configuration of supporting the image carrier, and wherein the second frequency is a frequency set for moire generation preventing measures to prevent generation of irregularity in scanning cycles at a time of forming the electrostatic latent image.

5. The image forming apparatus according to claim 4, wherein switching by the switching unit is made when the first frequency and the second frequency of the frequency of the alternating voltage are unable to coexist in a predetermined frequency range.

6. The image forming apparatus according to claim 5, wherein a lower limit value of the predetermined frequency range is a minimum frequency at which the image carrier is chargeable, and wherein an upper limit value of the predetermined frequency range is a maximum frequency at which impact on the image carrier is allowed.

7. An image forming apparatus comprising:

an image processing unit that comprises a plurality of devices, the plurality of devices comprising:

a charging unit that is provided to face an image carrier and applies a direct current voltage on which an alternating voltage of a first frequency is superimposed to charge the image carrier;

an electrostatic latent image forming unit that forms an electrostatic latent image on the charged image carrier with light scanning based on image information;

a developing unit that develops the electrostatic latent image; and a transfer unit that transfers the developed image to a recording medium; and a switching unit that switches a frequency of the alternating voltage at least during charging performed by the charging unit to a second frequency different from the first frequency if (i) an image density based on the image information is greater than or equal to a specific image density and (ii) the first frequency and the second frequency are unable to coexist in a predetermined frequency range, wherein a lower limit value of the predetermined frequency range is a minimum frequency at which the image carrier is chargeable, and wherein an upper limit value of the predetermined frequency range is a maximum frequency at which impact on the image carrier is allowed.

8. An image forming apparatus comprising:

an image processing unit that comprises a plurality of devices, the plurality of devices comprising:

a charging unit that is provided to face an image carrier and applies a direct current voltage on which an alternating voltage of a first frequency is superimposed to charge the image carrier;

an electrostatic latent image forming unit that forms an electrostatic latent image on the charged image carrier with light scanning based on image information;

a developing unit that develops the electrostatic latent image; and a transfer unit that transfers the developed image to a recording medium; and a switching unit that switches a frequency of the alternating voltage at least during charging performed by the charging unit to a second frequency different from the first frequency if (i) an image density based on the image information is greater than or equal to a specific image density and (ii) the first frequency and the second frequency are unable to coexist in a predetermined frequency range, the switching unit switching to the second frequency in a period that extends from a start of transport of the recording medium before an image forming process to an end of operation of at least one of the plurality of devices after the image forming process, wherein a lower limit value of the predetermined frequency range is a minimum frequency at which the image carrier is chargeable, and wherein an upper limit value of the predetermined frequency range is a maximum frequency at which impact on the image carrier is allowed.

* * * * *